US005720153A

United States Patent [19]

Martin-Cocher

[11] Patent Number: 5,720,153

[45] Date of Patent: Feb. 24, 1998

[54] WRAPPING METHOD, AND APPARATUS FOR IMPLEMENTING SAID METHOD

[75] Inventor: Jean-Paul Martin-Cocher, La Motte Servolex, France

[73] Assignee: Newtec International, Viroflay, France

[21] Appl. No.: 753,632

[22] Filed: Nov. 27, 1996

Related U.S. Application Data

[63] Continuation of Ser. No. 338,611, filed as PCT/FR94/00333 Mar. 25, 1994, published as WO94/22719 Oct. 13, 1994.

[30] Foreign Application Priority Data

Mar. 26, 1993 [FR] France ..... 93 03512

[51] Int. Cl.[6] ..... B65B 13/02

[52] U.S. Cl. ..... 53/399; 53/588; 53/442; 53/137.2; 53/176; 53/553; 206/598

[58] Field of Search ..... 53/399, 441, 442, 53/410, 419, 587, 588, 556, 557, 138.1, 137.2, 176, 553, 554, 555; 206/597, 497, 386, 598

[56] References Cited

U.S. PATENT DOCUMENTS

| | | | |
|---|---|---|---|
| 3,853,218 | 12/1974 | Grasvoll . | |
| 3,945,493 | 3/1976 | Cardinal | 53/442 |
| 4,829,744 | 5/1989 | Kapke | 53/410 |
| 4,993,209 | 2/1991 | Haloila | 53/588 |
| 5,003,752 | 4/1991 | Matsumoto | 53/588 |

FOREIGN PATENT DOCUMENTS

| | | |
|---|---|---|
| 156 012 | 10/1985 | European Pat. Off. . |
| 291 858 | 11/1988 | European Pat. Off. . |
| 2 090 893 | 1/1972 | France . |
| 24 48 720 | 4/1975 | Germany . |
| 41 03 384 | 8/1991 | Germany . |

*Primary Examiner*—John Sipos
*Assistant Examiner*—John Paradiso
*Attorney, Agent, or Firm*—Bell, Seltzer, Park & Gibson, P.A.

[57] ABSTRACT

The present invention relates mainly to a wrapping method and to apparatus for implementing the method. The invention provides a method of wrapping a palletized load, the method comprising a step of depositing one or more plastic films around the palletized load, thereby covering the palletized load and closing the inlets to the pallet, the method including a step that consists in disengaging permanent passages in the film where it obstructs the inlets of the pallet for passing the forks of handling equipment. The present invention is particularly applicable to wrapping palletized loads. A main application of the present invention lies in wrapping loads that are palletized on standard pallets.

17 Claims, 4 Drawing Sheets

WRAPPING METHOD, AND APPARATUS FOR IMPLEMENTING SAID METHOD

This application is a continuation of copending application Ser. No. 08/338,611, filed as PCT/FR94/00333 Mar. 25, 1994, published as WO94/22719 Oct. 13, 1994.

The present invention relates mainly to a wrapping method, and to apparatus for implementing said method.

BACKGROUND OF THE INVENTION

Palletization of loads is becoming and more important insofar as it makes it possible to reduce the costs of handling, storing, and transporting goods. The advantage of palletization is achieved only if the load reaches its ultimate stage, i.e. if it is depalletized in the state in which it was to be found during palletization. It is common practice to use a plastic film wrapping to protect, support, and/or hold together palletized loads, with the load and the pallet being themselves held together, for a standardized pallet, by winding the film beneath the bottom slab of the pallet. A pallet protected in this way is handled by machines such as forklift trucks and pallet transporters having forks that penetrate into the pallet by puncturing, or worse tearing, the plastic film wrapping. This weakens or destroys the connection between the pallet and the palletized load.

In addition, the connection between the wrapping and the pallet can be compromised by friction between the film wrapping beneath the bottom slab of the pallet and the ground, unloading bays, or the decks of trucks.

Known methods of securing a palletized load to a pallet exist that do not have those drawbacks: for example, the film is hooked beneath the top plate of the pallet; or the end of the wrapping is secured in notches formed in the blocks interconnecting the top and bottom plates of the pallet. However, those methods do not apply to standard pallets which constitute 90% of the reusable pallets in use throughout the world.

OBJECTS AND SUMMARY OF THE INVENTION

Consequently, an object of the present invention is to provide a method and apparatus for securing wrapping to the pallet without running the risk of the wrapping being damaged or destroyed by the forks of handling equipment.

Another object of the present invention is to provide such a method and such apparatus suitable for being used with standardized pallets.

Another object of the present invention is to make up palletized loads in which the wrapping runs no risk of being damaged or destroyed by the pallet rubbing against the ground, unloading bays, or the decks of trucks.

Another object of the present invention is to provide such a method that is automatic or easily automated.

Another object of the present invention is to provide such a method that enables the wrapping to be secured to the pallet at a cost that is low.

Another object of the present invention is to provide such a method that uses a small quantity of plastic film for securing wrapping to a pallet.

These objects are achieved by fixing a fastening strip to the bottom of a palletized load, by folding said strip in such a manner as to leave passages for the forks of handling equipment, and by securing the fastening strip to wrapping for the load, and in particular to a shrinkable cover. In a variant, the bottom portion of wrapping of the cover or casing type is secured directly to the pallet and passages for the forks of handling equipment are disengaged therein by folding up the portions of the wrapping that obstruct the inlets of the pallet.

The invention provides a method of wrapping a palletized load, the method including a step of depositing one or more plastic films around the palletized load, thereby covering the palletized load and closing the inlets to the pallet, the method including a step that consists in disengaging permanent passages in the film obstructing the inlets of the pallet for the purpose of passing the forks of handling equipment.

The invention also provides a method, including the steps consisting in:

a) fixing a fastening strip around the pallet; and b) securing the wrapping to the fastening strip.

The invention also provides a method wherein permanent passages are disengaged through the film obstructing the inlets of the pallet in corresponding positions on two opposite sides of the pallet.

The invention also provides a method wherein permanent passages are disengaged at the inlets of the pallet by folding the film obstructing the inlets of the pallet and by securing the resulting folds, in particular by welding.

The invention also provides a method wherein the wrapping is constituted by a shrinkable cover, and wherein step b) is implemented by heating that serves simultaneously to weld the fastening strip to the cover and to shrink said cover.

The invention also provides a method wherein the pallet carrying the load to be wrapped is a standard pallet having a top plate and a bottom plate that are substantially identical to each other and that are interconnected by blocks substantially in the form of rectangular parallelepipeds.

The invention also provides apparatus for wrapping palletized loads, including means for dispensing a film and for forming a fastening strip around the pallet, the strip being suitable for securing to wrapping, in particular to a cover, and wherein the apparatus includes means for disengaging passages in the fastening strip at at least some of the inlets of the pallet for receiving the forks of handling equipment.

The invention also provides apparatus wherein the means for disengaging the passages for the forks of handling equipment at at least some of the inlets of the pallet include thrust elements for folding the fastening strip and means for permanently connecting the folds together, in particular welding means.

The invention also provides apparatus including means for depositing wrapping, in particular a cover, and means for securing the fastening strip together with the wrapping.

The invention also provides apparatus wherein the wrapping, in particular the cover, is made of a shrinkable plastics film, and wherein the apparatus includes heating means for shrinking the wrapping.

The invention also provides apparatus including in that it includes a ring suitable for surrounding the pallet, and wherein the means for dispensing a thin film suitable for constituting the fastening strip are mounted to rotate around the pallet on the ring.

The invention also provides apparatus wherein the means for dispensing the plastics film suitable for forming the fastening strip include a stretching roll that is narrow compared to the width of the plastics film, for the purpose of stretching the central portion of said film.

BRIEF DESCRIPTION OF THE DRAWINGS

The invention will be better understood from the following description and the accompanying drawings given as non-limiting examples, and in which:

In FIGS. 1 to 10, the same references are used to designate the same elements.

MORE DETAILED DESCRIPTION

Figure 1:
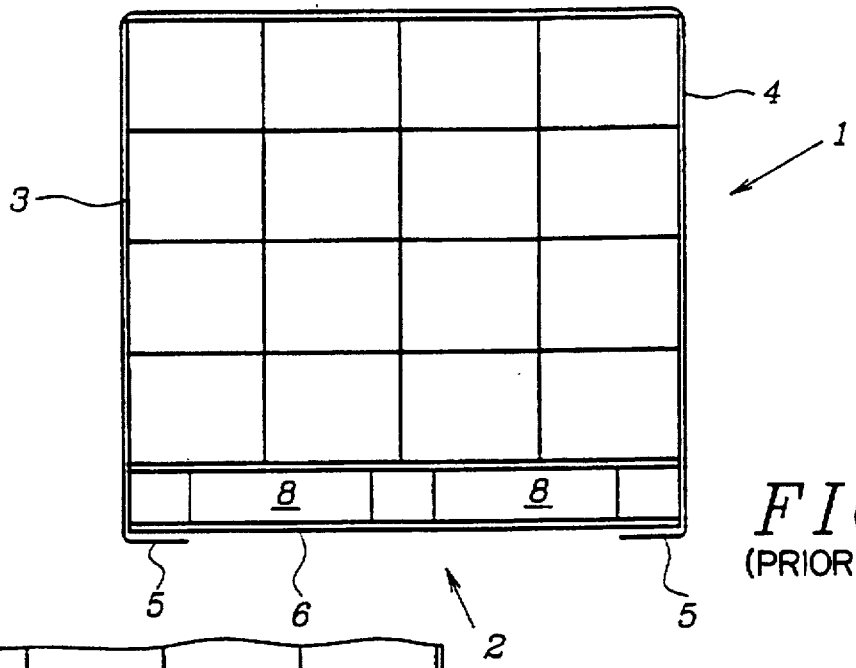
FIG.1 (PRIOR ART)
FIG. 1 is an elevation view of a palletized load of known type.

In FIG. 1, there can be seen a palletized load 1 of conventional type comprising a pallet 2 carrying a load 3 covered with a cover 4 made of a plastics film that has been shrunk during a heating step. The cover 4 has flaps 5 passing beneath the bottom slab 6 of the pallet 2. These flaps 5 serve initially to secure the load 3 to the pallet and to hold the palletized load together reliably. Unfortunately, rubbing of the palletized load 1 on the ground, on loading bays, or on the decks of trucks has the effect of destroying the flaps 5 and can thus cause the palletized load 1 to become dislodged.

Figure 2:
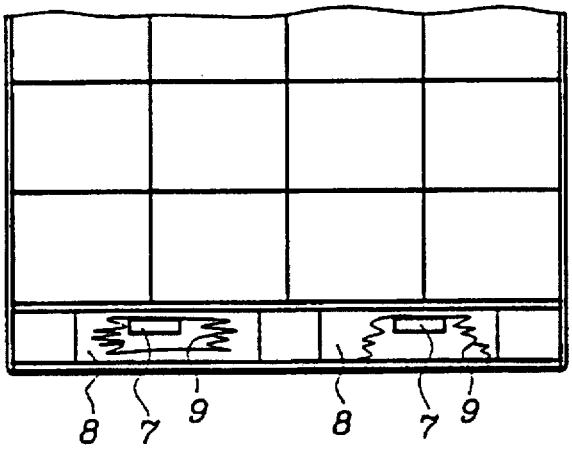
FIG.2 (PRIOR ART)
FIG. 2 is an elevation of the pallet of FIG. 1 after the wrapping has been damaged by handling using equipment having a fork.

In addition, as shown in FIG. 2, by penetrating into inlets 8 in the pallet being handled, the forks 7 of forklift trucks or of pallet transporters perforate or worse tear the outer wrapping. The tears 9 present on two or on all four sides of the pallet 2 prevent the plastic wrapping film from guaranteeing that the palletized load 1 will hold together. This can result in the palletized load 1 becoming dislodged, thereby damaging the packets making up the load 3.

Figure 3:
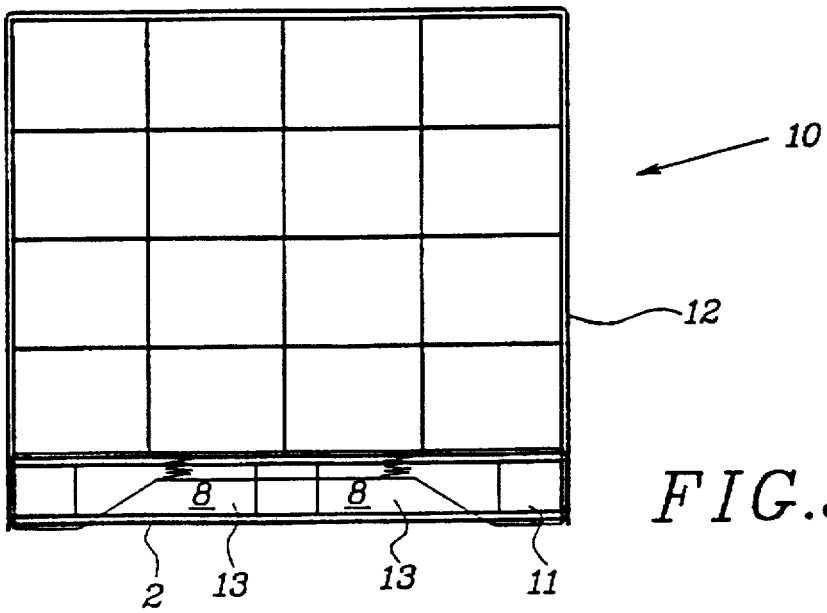
FIG. 3 is an elevation view of a palletized load of the present invention.

FIG. 3 shows a palletized load 10 of the present invention which includes a fastening strip 11 for securing the outer wrapping 12 while leaving passages 13 to the inlets 8 of the pallet 2 on two or four sides thereof.

The fastening strip 11 is secured to the outer wrapping 12 by welding or by adhesive, for example.

The passages 13 allow forks 7 to penetrate into the inlets of the pallet without puncturing or tearing the outer wrapping 12, or the fastening strip 11.

By using a fastening strip 11 that is distinct from the outer wrapping 12, a very wide range of choice is made available for the plastic films used to implement these two elements. Thus, for example, the outer wrapping 12 may be constituted by a cover or casing adapted to protect the load 3 and to hold it together, while the fastening strip 11 is made of a film that withstands traction and/or rubbing.

Figure 4:
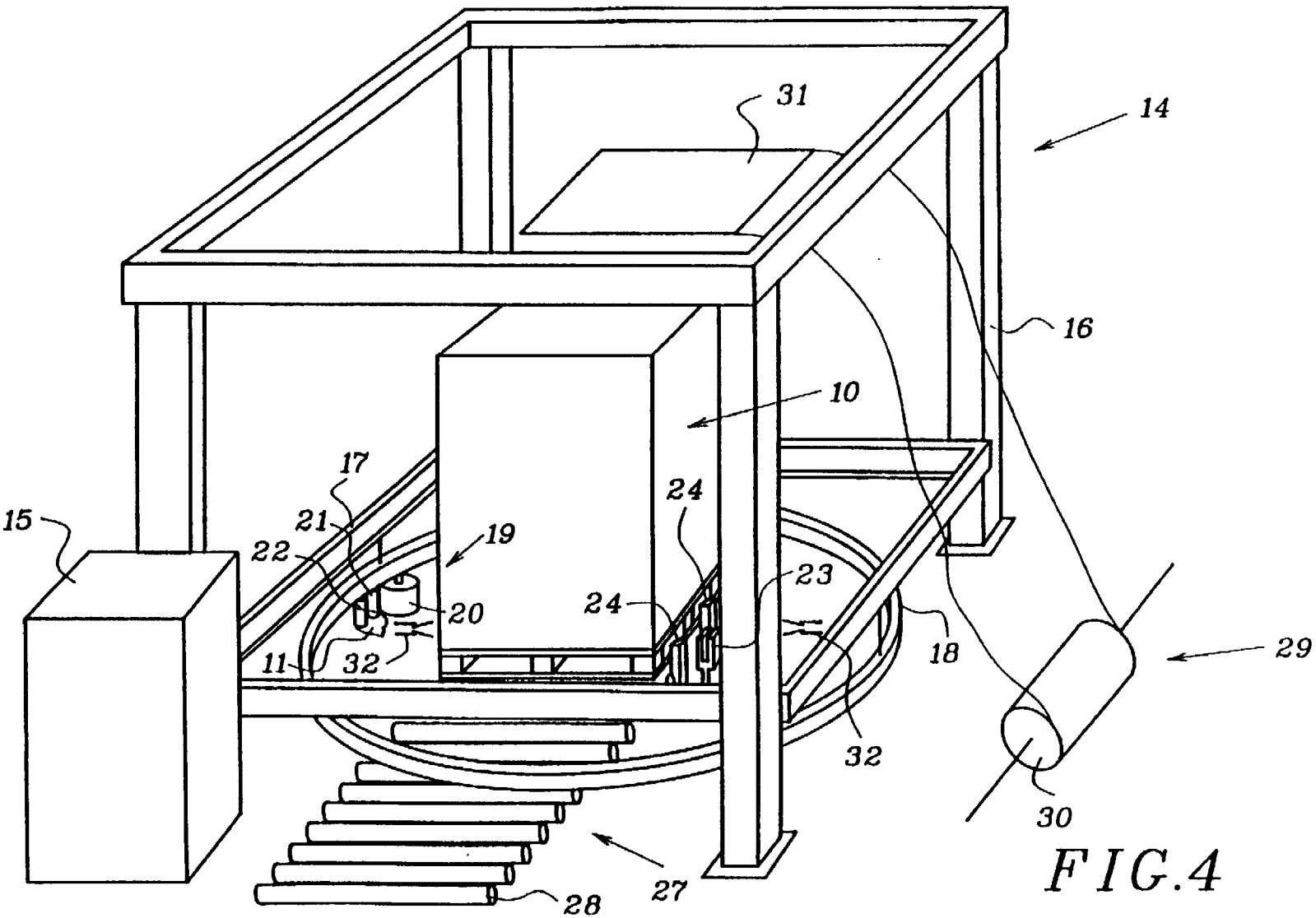
FIG. 4 is perspective view of a preferred embodiment of wrapping apparatus of the present invention.

FIG. 4 shows a preferred embodiment of wrapping apparatus 14 of the present invention.

The apparatus 14 comprises a programmable controller 15 and a stand 16 having a frame 17 mounted thereon for supporting a ring 18 that includes a device 19 for dispensing a plastic film that forms the fastening strip 11. Advantageously, this film is a thin stretchable film that is slightly sticky. For example, the device 19 comprises a reel 20 of stretchable plastic film for forming the fastening strip 11, and two rollers 21 and 22 that are advantageously motor driven for stretching the film. Drive means (not shown) under the control of the programmable controller 15 cause the film dispensing device 19 to move around the ring 18 and to move the frame 17 in vertical translation, enabling it to be retracted, advantageously vertically, whenever a palletized load for wrapping is being fed into the apparatus or removed therefrom. The apparatus 14 of the invention includes, level with the pallet 2, means 23 for temporarily fixing the end of the film that forms the strip 11 for fastening the wrapping, which means include, for example, a clamp together with means 24 for keeping the fastening strip 11 away from the inlets to the pallet 2 by forming passages 13 in the strip 11 for the forks 7. By way of example, the means 24 may be constituted by two stops disposed over two opposite sides (as shown), or else stops formed over all four sides of the pallet 2.

Figure 6:
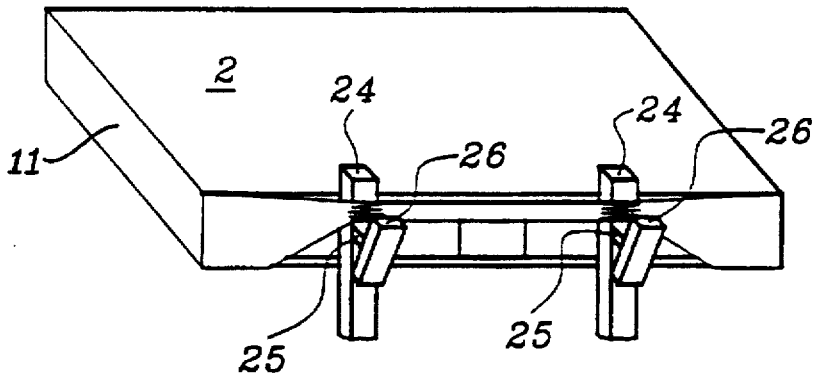

As can be seen in FIG. 6, each stop of the means 24 comprises a thrust element 25 which is advantageously driven upwards by an actuator (not shown) to fold the films and thus leave open the passages 13, and which is associated with a welder 26 for welding the folds together so as to ensure that the formation of said passages 13 is permanent. When stops are implemented on all four sides of the pallet 2, some of the stops are retractable to allow pallets to be put into place and/or removed, e.g. by means of a conveyor 27 made up of motor-driven rollers 28. In the example shown, the means 24 for disengaging the fastening strip 11 from the inlets 8 of the pallet 2 are constituted by four stops only disposed on two opposite sides of the conveyor 27 and that are retracted solely for escaping from the fastening strip 11. Advantageously, the apparatus 14 of the invention includes means for raising the pallet 2 so as to allow the fastening strip 11 or the cover 12 to pass beneath the bottom slab 6 of the pallet 2.

The apparatus 14 of the invention advantageously includes means for installing outer wrapping 12 that is adapted to the palletized load. In the advantageous example shown, the apparatus 14 includes means 29 for installing shrinkable covers, which means comprise a reel 30 for paying out a sheath of shrinkable film, means for cutting and welding the top portion of the cover (not shown), guide means 31 for providing guidance while the cover is being put into place on the palletized load, e.g. a frame, and heating means 32 for shrinking the cover. The heating means 32 may be constituted, for example, by an oven, or by a heating frame using hot air, a direct flame, electric infrared sources, or gas infrared sources.

Naturally, implementing the wrapping apparatus 29 and/or the heating means 32 separately from the apparatus 14 of the invention does not go beyond the ambit of the present invention.

Similarly, implementing a device 19 for dispensing the film that forms the fastening strip 11 in the form of a fixed device associated with means for rotating the palletized load 10 does not go beyond the ambit of the present invention either.

Implementation of the method of the present invention is explained below with reference to FIGS. 4 to 8.

The end of the film forming the fastening strip 11 is secured by hand or by a manipulator under the control of the programmable controller 15 (not shown) in the means 23.

Figure 5:
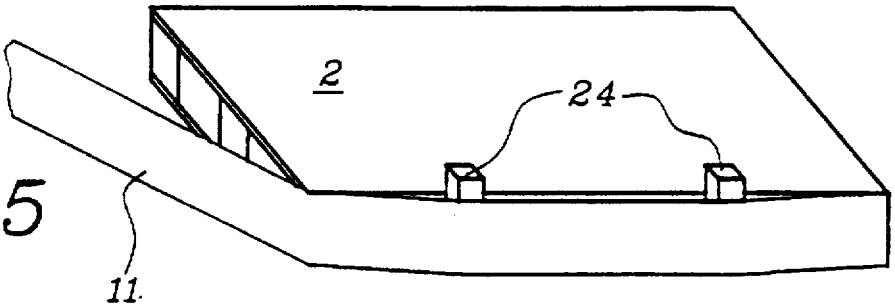
FIGS. 5 to 8 are diagrams for explaining the implementation of the method of the present invention.

As shown in FIG. 5, the means 19 for dispensing the film that forms the fastening strip 11 perform at least one complete turn, depositing stretched strip around the pallet 2 and around the stops of the means 24. Once the fastening strip 11 has been made up, the film is cut and the tail end of the film is welded to the earlier turn(s).

As shown in FIG. 6, the thrust elements 25 locally fold the fastening strip 11, thereby disengaging the passages 13. The welders 26 weld the folds together, thereby holding the passages 13 open after the stops of the means 24 have been disengaged.

Figure 7:
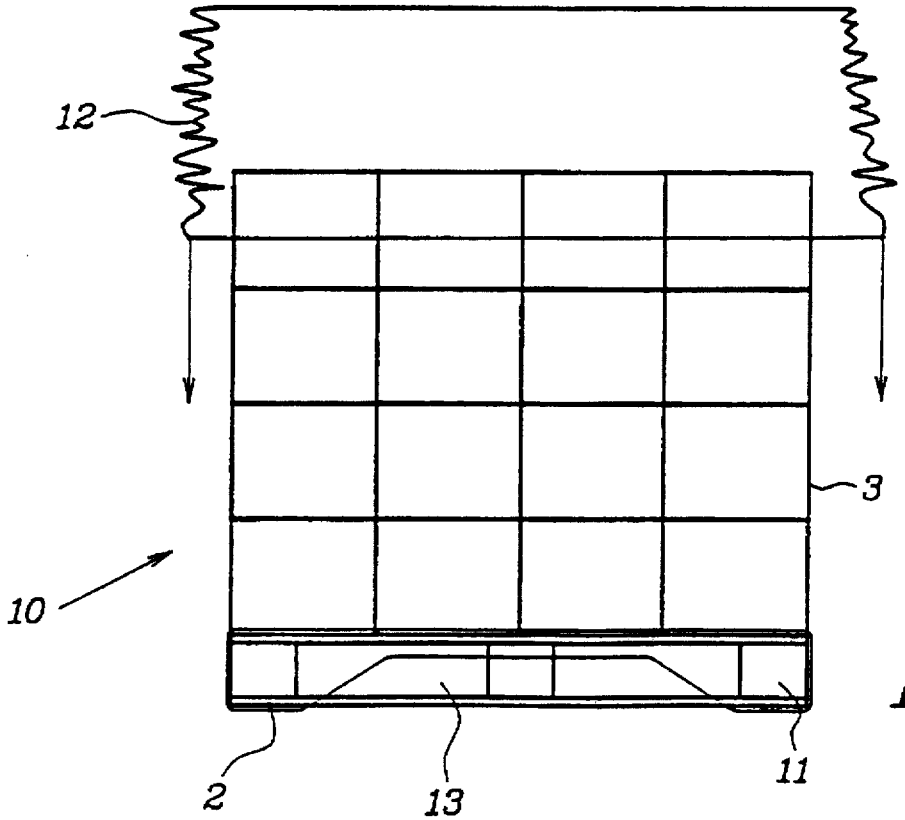

As shown in FIG. 7, outer wrapping 12, e.g. in the form of a shrinkable cover, is placed on the palletized load. The outer wrapping 12 is fixed to the fastening strip 11, advantageously by welding caused by the heat required for shrinking the cover.

Figure 8:
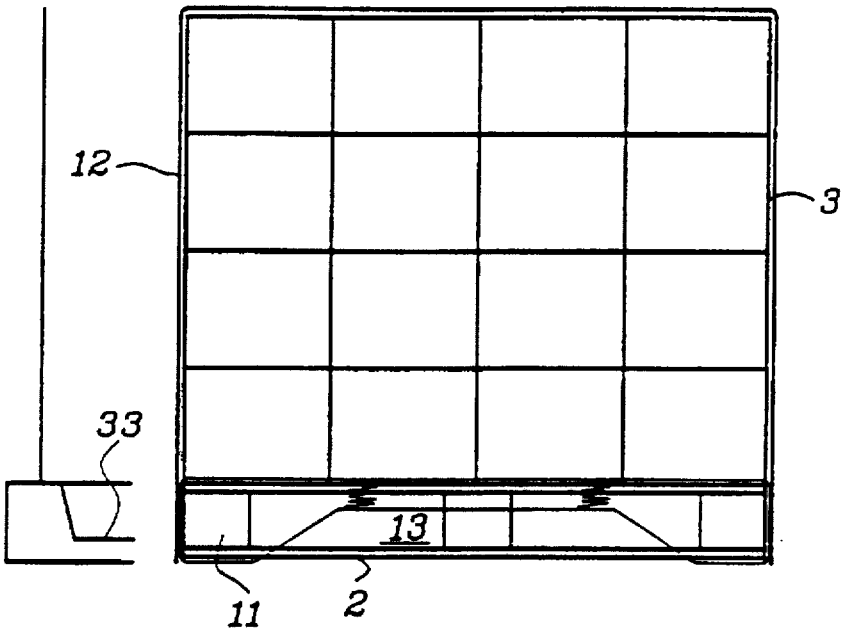

In a variant, as shown in FIG. 8, the outer wrapping is welded, e.g. by a welding arm 33, or else it is secured by adhesive during a separate step of the method of the present invention.

Figure 9:
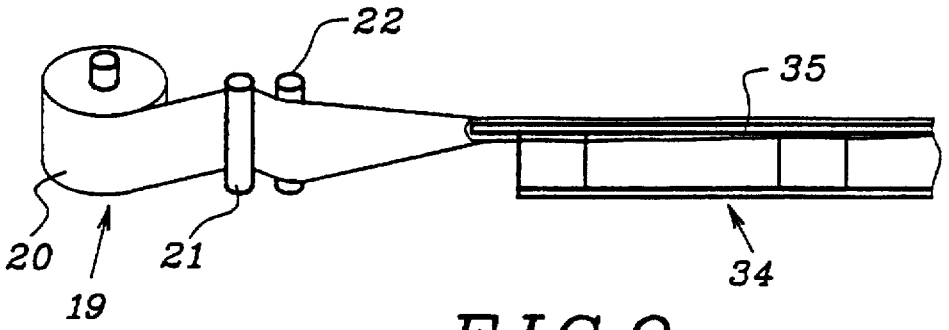
FIG. 9 is a perspective view showing a detail of a variant embodiment of the apparatus of the present invention adapted to pallets that have an overhanging top plate.
Figure 10:
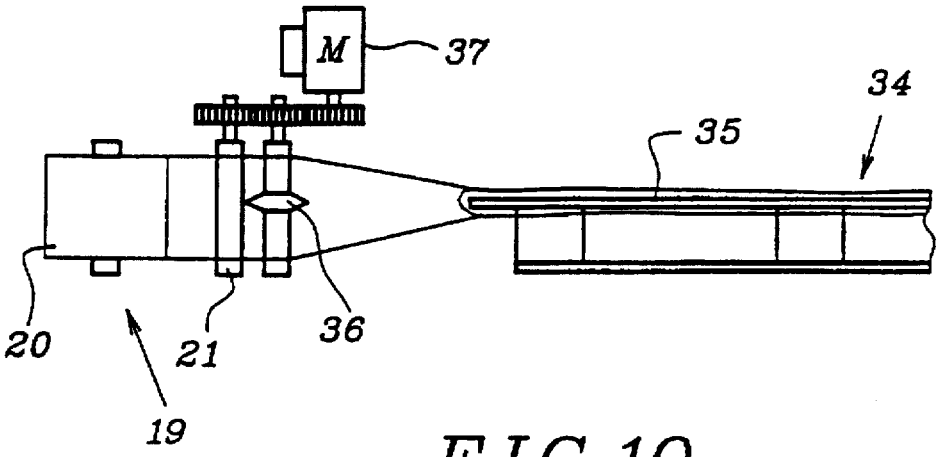
FIG. 10 is a perspective view of a variant embodiment of the FIG. 9 apparatus.

The apparatus and of the method of the invention can be adapted to special pallets. In FIGS. 9 and 10, there can be seen two embodiments of the device 19 particularly well adapted to pallets 34 having an overhanging top plate 35. The film constituting the fastening strip 11 is advantageously deposited in a pre-stretched state on the edges of the overhanging plate 35.

In the variant of FIG. 10, the device 19 includes a pre-stretching roll 36 that is narrow compared to the width of the film, the roll advantageously being driven by a motor 37 and bearing substantially against the middle of the film. This serves to stretch the strip to a greater extent in the middle where it overlies the plate 35. For a given quantity and quality of film, this device makes it possible to envelop the overhanging plate 35 better while minimizing risks of the film being torn.

A pallet 10 wrapped by the method of the present invention includes passages 13 on at least one side, and preferably on two opposite sides or on all four sides, providing access for forks 7 to the inlets 8 of the pallet 2 without damaging the outer wrapping 12. In addition, rubbing of the palletized load 10 on the ground, on loading bays, or on the decks of trucks does not damage the fastening between the outer wrapping and the pallet.

Naturally, it would not be going beyond the ambit of the present invention to implement other types of outer wrapping such as stretchable covers, or a casing made of stretchable, shrinkable, and/or stretch-shrinkable film fixed to a fastening strip 11 which is itself stretchable, shrinkable, and/or stretch-shrinkable.

Similarly, fastening the outer wrapping directly to the pallet while leaving open the inlets to the pallet 2 does not go beyond the ambit of the present invention.

The present invention is particularly applicable to wrapping palletized loads.

The main application of the present invention lies in wrapping palletized loads on standard pallets.

I claim:

1. A method of wrapping a palletized load on a pallet having inlets for receiving the forks of handling equipment, the method including the steps of:

depositing at least a first plastic film substantially around the pallet of palletized load thereby covering and closing at least part of the pallet inlets;

moving the first film obstructing the inlets of the pallet so as to substantially disengage said first film from said inlets without substantially tearing said first film;

depositing a second plastic film around the load without substantially covering the pallet inlets so that the forks of handling equipment may be inserted into the cleared inlets of the pallet without substantially damaging the second film deposited around the load; and securing the second film to the first film.

2. A method according to claim 1, wherein permanent passages are disengaged through the film obstructing the inlets of the pallet in corresponding positions on two opposite sides of the pallet.

3. A method according to claim 1, wherein permanent passages are disengaged at the inlets of the pallet by folding the film obstructing the inlets of the pallet and by securing the resulting folds by welding.

4. A method according to claim 1 wherein said steps of depositing said second film includes depositing said second film which has a physical property distinct from said first film.

5. A method according to claim 1 wherein said step of depositing said first film includes securing said first film independently from said step of depositing said second film.

6. A method according to claim 1 wherein said step of depositing said first film includes horizontally depositing a narrow horizontal fastening strip of said first film so as to cover the pallet inlets.

7. A method according to claim 1 wherein said step of depositing said first film around the bottom of the palletized load includes depositing said first film so as not to substantially cover the load.

8. A method according to claim 1 wherein said step of securing the first film to the second film is a welding step wherein at least a portion of the second film shrinks during said welding step.

9. A method according to claim 1 wherein said step of depositing said second film around the load includes depositing the second film so as not to substantially cover the bottom of the palletized load covered by said first film.

10. A method according to claim 1 wherein said step of depositing said second film includes depositing a shrinkable film about the load.

11. An apparatus for applying wrapping to palletized loads on a pallet having inlets for receiving the forks of handling equipment comprising means for dispensing a first film around the bottom of the palletized load to form a narrow, horizontally extending fastening strip around the pallet so that the first film substantially closes the inlets while not substantially covering the load, a thrust element for moving the first film obstructing the inlets of the pallet so as to disengage said first film from at least some of the inlets of the pallet for receiving the forks of handling equipment, and means for dispensing a second film over the load on the pallet without substantially covering the inlets wherein said thrust element disengages the inlets without substantially damaging the film around the load.

12. An apparatus according to claim 11 wherein said means for dispensing said first and second films are different and said means for dispensing said first film dispenses said film in a direction different than said means for dispensing said second film.

13. An apparatus according to claim 11 further including means for permanently connecting folds of said second film resulting from said thrust elements to permanently disengage said pallet inlets.

14. An apparatus according to claim 11 further including means for securing said second film to said first film.

15. An apparatus according to claim 11 wherein said second film is a shrinkable plastic film and said apparatus further comprises means for heating the shrinkable plastic film.

16. An apparatus according to claim 11 wherein said apparatus further comprises a ring and said means for depositing the first film is mounted to rotate on said ring.

17. An apparatus according to claim 11 wherein said means for dispensing the first film includes a stretching roll which is narrow relative to a width of the first film for stretching a central portion of said first film.

* * * * *